US011064769B2

(12) United States Patent
Wang et al.

(10) Patent No.: US 11,064,769 B2
(45) Date of Patent: Jul. 20, 2021

(54) ROTARY BELT BUCKLE

(71) Applicant: Qing Can Xing Hardware Crafts Co., Ltd., Fujian (CN)

(72) Inventors: Nianqing Wang, Fujian (CN); Jindang Wang, Fujian (CN)

(73) Assignee: Qing Can Xing Hardware Crafts Co., Ltd., Fujian (CN)

( * ) Notice: Subject to any disclaimer, the term of this patent is extended or adjusted under 35 U.S.C. 154(b) by 0 days.

(21) Appl. No.: 16/560,765

(22) Filed: Sep. 4, 2019

(65) Prior Publication Data

US 2019/0387843 A1 Dec. 26, 2019

(30) Foreign Application Priority Data

Oct. 10, 2018 (CN) ..... 201821643247.5

(51) Int. Cl.
*A44B 11/00* (2006.01)

(52) U.S. Cl.
CPC ..... *A44B 11/006* (2013.01)

(58) Field of Classification Search
CPC ..... A44B 11/006; A44B 11/24
See application file for complete search history.

(56) References Cited

U.S. PATENT DOCUMENTS

| | | | | |
|---|---|---|---|---|
| 4,458,390 | A * | 7/1984 | Fogelson | A44B 11/006 24/182 |
| 7,480,967 | B2 * | 1/2009 | Kojoori | A44B 11/006 2/322 |
| 9,320,325 | B2 * | 4/2016 | Chen | A44B 11/006 |
| 9,930,935 | B2 * | 4/2018 | King | A44B 11/006 |
| 10,357,082 | B2 * | 7/2019 | Liu | A44B 11/24 |
| 10,441,063 | B2 * | 10/2019 | Pollack | G09F 3/14 |
| 2003/0033697 | A1 * | 2/2003 | Hicks | A44B 11/266 24/615 |
| 2013/0139300 | A1 * | 6/2013 | Laiken | A41F 9/002 2/321 |
| 2020/0046084 | A1 * | 2/2020 | Rowland | A41F 9/002 |

FOREIGN PATENT DOCUMENTS

| | | | | |
|---|---|---|---|---|
| FR | 2803723 | A1 * | 7/2001 | A44B 11/006 |

* cited by examiner

*Primary Examiner* — Victor D Batson
*Assistant Examiner* — Matthew J Sullivan

(57) ABSTRACT

A rotary belt buckle includes a belt fastener connection part, a belt connection part, and a spring mechanism. The belt connection part is connected with the belt fastener connection part through the spring mechanism, the belt connection part rotates around the belt fastener connection part; the belt fastener connection part has a slot, a strip unit which is located on the belt connection part fits with the slot; the belt connection part includes a cover plate and a box body, the strip unit includes an upper strip and a lower strip. The upper strip is located on the cover plate, and the lower strip is located on the box body. The upper strip is fixed with the lower strip to avoid the belt from being easily taken out of the belt buckle, to achieve a quick replacement of the belt, saving time of a user to replace the belt.

2 Claims, 3 Drawing Sheets

ROTARY BELT BUCKLE

CROSS REFERENCE OF RELATED APPLICATION

The present invention claims priority under 35 U.S.C. 119(a-d) to CN 201821643247.5, filed Oct. 10, 2018.

BACKGROUND OF THE PRESENT INVENTION

Field of Invention

The present invention relates to the field of clothing technology, and more particularly to a rotary belt buckle.

Description of Related Arts

In people's daily life, the belt is one of the garments that are tied to the waist of the people and plays a role in tightening the clothes. It is often worn by people. The existing belt buckles mostly fix the belt by means of a nail piercing and clamping the belt. When the belt is used, the belt often moves relatively to the nail due to the pulling force from being gathered, and the belt connection part of the existing belt buckles is generally movable, so that when the pulling force is too large, the belt is easily to be detached from the belt buckle.

In view of the above description, the inventors of the present invention have specially developed a rotary belt buckle, and the present invention is produced.

SUMMARY OF THE PRESENT INVENTION

To solve the above technical problem, the present invention provides a rotary belt buckle.

To achieve the above object, a technical solution adopted by the present invention is as follows. A rotary belt buckle, which comprises: a belt fastener connection part, a belt connection part, and a spring mechanism, wherein: the belt connection part is connected with the belt fastener connection part through the spring mechanism, the belt connection part rotates around the belt fastener connection part; the belt fastener connection part has a slot, a strip unit which is located on the belt connection part fits with the slot; the belt connection part comprises a cover plate and a box body, the strip unit comprises an upper strip and a lower strip, wherein: the upper strip is located on the cover plate, the lower strip is located on the box body.

Further, the upper strip and the lower strip are engaged with each other to fit with the slot, both the upper strip and the lower strip are restricted by the slot.

Further, two ribs, which are respectively provided at two sides of the slot, respectively fit with two ends of the strip unit.

Further, each of the two ribs is arch-shaped for allowing the strip unit to be easily taken out of the slot.

Further, one end of the cover plate is rotatably connected with the box body, the other end of the cover plate is movably connected with the box body.

Further, a connection shaft, which is located on the box body, is inserted into the slot.

Further, the connection shaft has a connection hole and a stepped surface therein, wherein the stepped surface is provided at an end of the connection hole.

Further, the spring mechanism, which is located within the connection hole, comprises a connector and a spring, wherein: the spring is located between the connector and the stepped surface.

Further, the connector has a screw structure, a clamping part is located at one end of the screw structure.

Further, a connection block is located within the slot, the connection block has a cruciform limit slot, the clamping part is inserted into the limit slot to be restricted by the limit slot.

It can be seen from the above description of the present invention, compared with the prior art, according to the rotary belt buckle provided by the present invention, the upper strip is fixed with the lower strip through engaging the upper strip with the lower strip within the slot; when the strip unit is taken out of the slot, the upper strip is detached from the lower strip, so as to avoid the belt from being easily taken out of the belt buckle, and at the same time achieve a quick replacement of the belt, saving time of a user to replace the belt.

DETAILED DESCRIPTION OF THE PREFERRED EMBODIMENT

A key of the present invention is to provide a rotary belt buckle, wherein: an upper strip is fixed with a lower strip through engaging the upper strip with the lower strip within a slot, so as to avoid the belt from being easily taken out of the belt buckle, and at the same time achieve a quick replacement of the belt.

The technical solutions according to the embodiments of the present invention will be clearly and completely described with accompanying drawings as follows. It is obvious that the described embodiments are only a part of the embodiments of the present invention, and not all of the embodiments. All other embodiments obtained by those skilled in the art based on the embodiments of the present invention without creative efforts are within the protective scope of the present invention.

Figure 1:
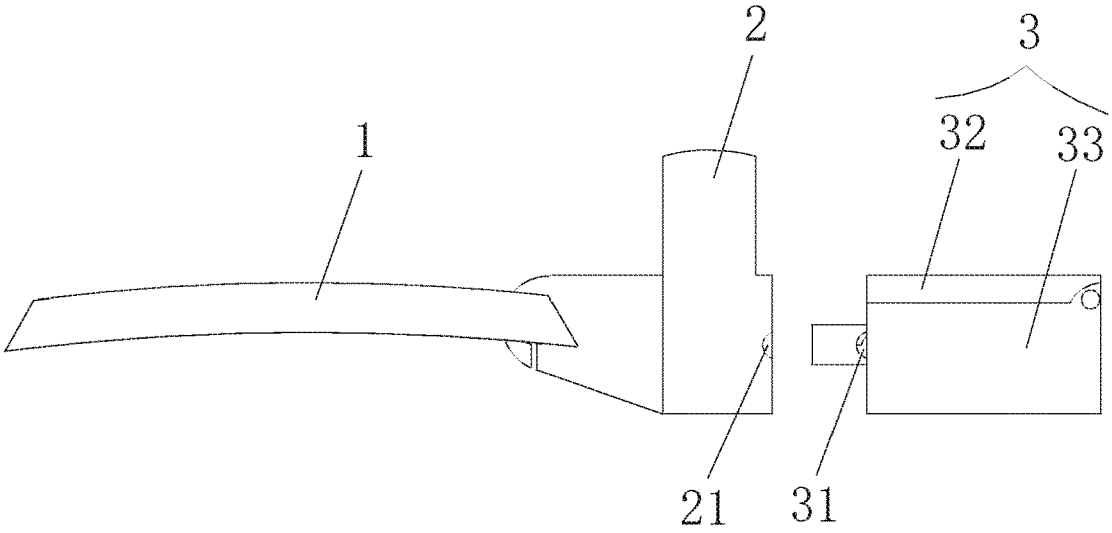
FIG. 1 is a structurally schematic view of a rotary belt buckle according to a preferred embodiment of the present invention.
Figure 2:
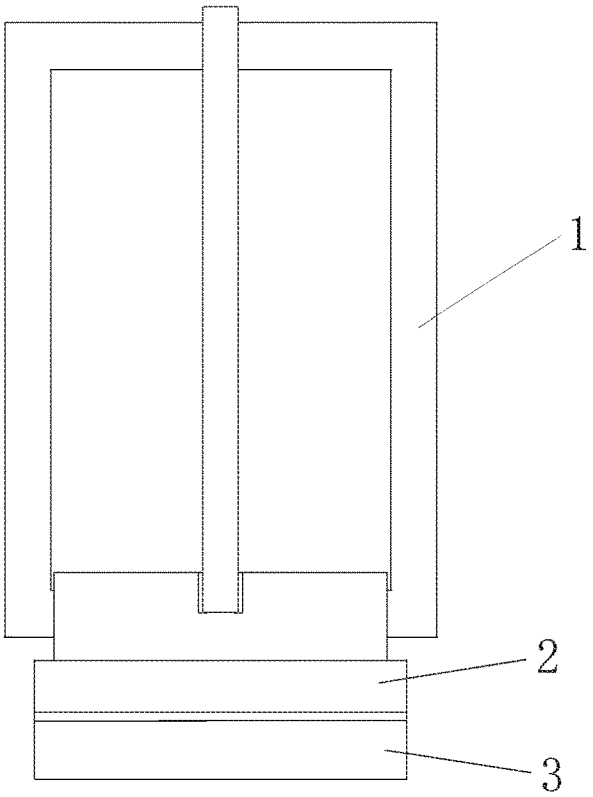
FIG. 2 is a top view of the rotary belt buckle according to the above preferred embodiment of the present invention.
Figure 3:
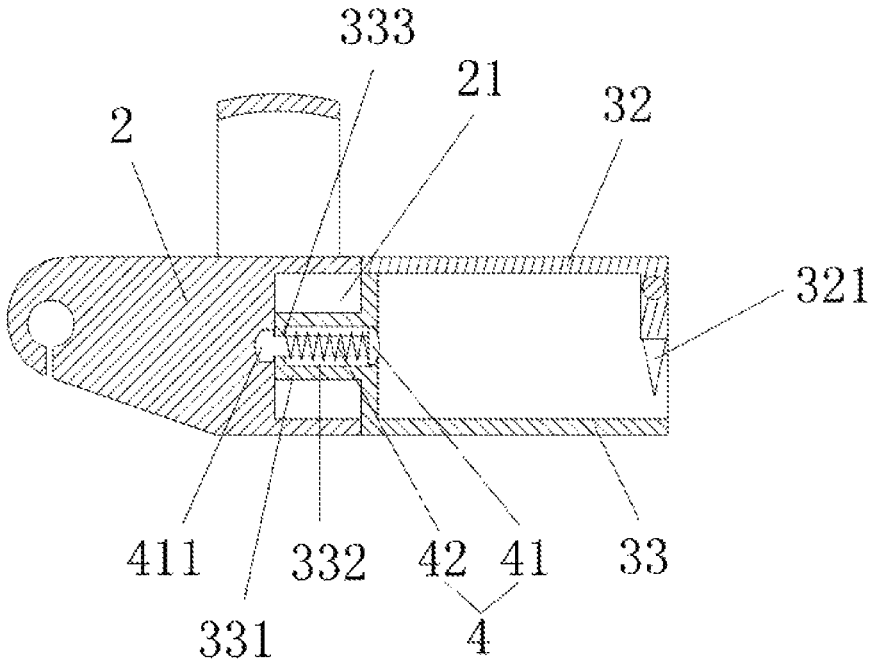
FIG. 3 is a connection schematic view of a belt fastener connection part and a belt connection part of the rotary belt buckle according to the above preferred embodiment of the present invention.
Figure 4:
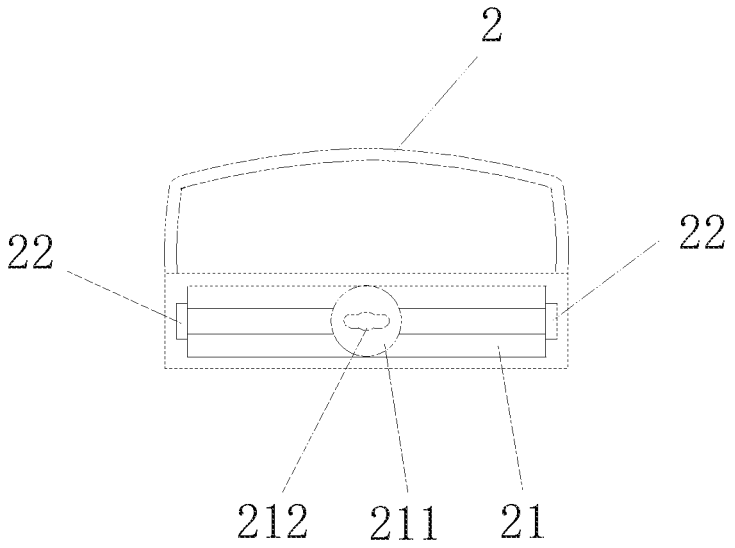
FIG. 4 is a side view of the belt fastener connection part of the rotary belt buckle according to the above preferred embodiment of the present invention.
Figure 5:
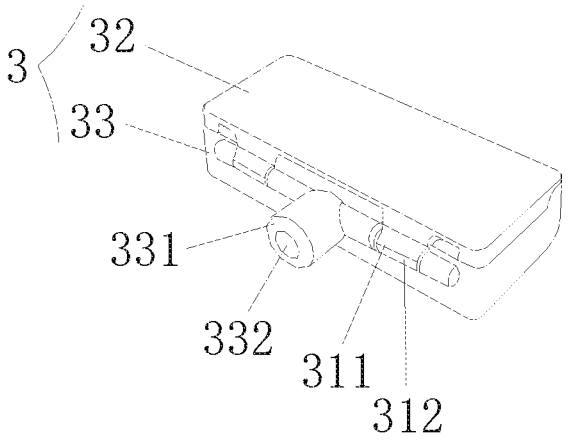
FIG. 5 is a structurally schematic view of the belt connection part of the rotary belt buckle according to the above preferred embodiment of the present invention.
Figure 6:
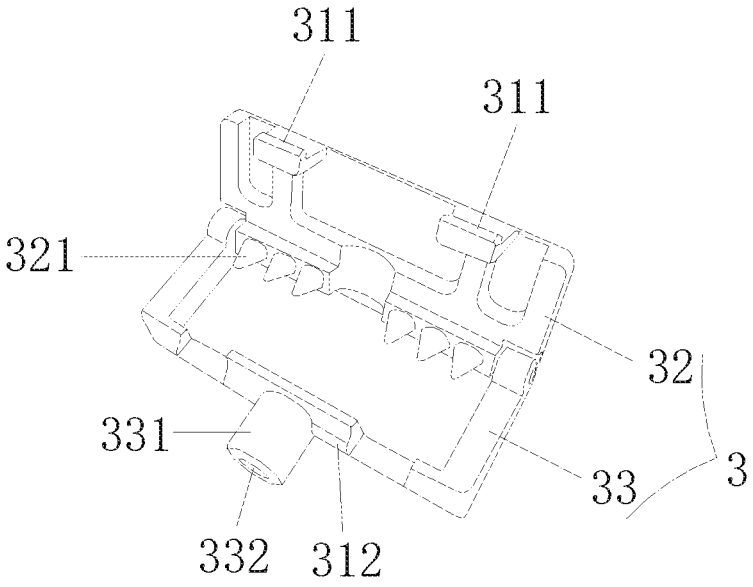
FIG. 6 is an expanded schematic view of the belt connection part of the rotary belt buckle according to the above preferred embodiment of the present invention.

Referring to FIGS. 1 to 6, the present invention provides a rotary belt buckle, which comprises a belt fastener 1, a belt fastener connection part 2, a belt connection part 3, and a spring mechanism 4, wherein: the belt fastener 1 is rotatably connected with the belt fastener connection part 2, the belt connection part 3 is connected with the belt fastener connection part 2 through the spring mechanism 4, the belt connection part 3 rotates around the belt fastener connection part 2.

The belt fastener connection part 2 has a slot 21, a strip unit 31 which is located on the belt connection part 3 fits with the slot 21.

The belt connection part 3 comprises a cover plate 32 and a box body 33 located below the cover plate 32, wherein: one end of the cover plate 32 is rotatably connected with the box body 33, the other end of the cover plate 32 is movably connected with the box body 33. The strip unit 31 comprises two upper strips 311 and a lower strip 312, wherein: the two upper strips 311 is located at the other end that the cover plate 32 is movably connected with the box body 33, the lower strip 312 is located on the box body 33, and is engaged with the two upper strips 311 when the rotary belt buckle is in a closed state.

Multiple nails 321 is located at the end of the cover plate 32 that the cover plate 32 is rotatably connected with the box body 33, the nails 321 and the upper strips 311 are respectively located at two ends of the cover plate 32, the nails 321 move with a flipping of the cover plate 32 for clamping and connecting with a belt.

The upper strips 311 and the lower strip 312 are engaged with each other to fit with the slot 21, both the upper strips 311 and the lower strip 312 are restricted by the slot 21. When the upper strips 311 and the lower strip 312 are accommodated within the slot 21, the cover plate 32 and the box body 33 are relatively closed to each other. When the upper strips 311 and the lower strip 312 are taken out of the slot 21, the other end that the cover plate 32 is movably connected with the box body 33 is opened relatively to the box body 33.

Two ribs 22, which are respectively provided at two sides of the slot 21, respectively fit with two ends of the strip unit 31 for restricting the strip unit 31, so as to prevent the belt connection part 3 from swinging left and right. Each of the two ribs 22 is arch-shaped for allowing the strip unit 31 to be easily taken out of the slot 21.

A connection shaft 331, which is located on the box body 33, is inserted into the slot 21. The connection shaft 331 has a connection hole 332 and a stepped surface 333 therein, wherein: the stepped surface 333 is provided at an end of the connection hole 332.

The spring mechanism 4, which is located within the connection hole 332, comprises a connector 41 and a spring 42, wherein: the spring 42 is located between the connector 41 and the stepped surface 333, the connector 41 has a screw structure, a clamping part 411 is located at one end of the screw structure. A connection block 211 is located within the slot 21. The connection block 211 has a cruciform limit slot 212 thereon. The clamping part 411 is inserted into the limit slot 212 to be restricted by the limit slot 212.

When the rotary belt buckle mentioned above is used, the belt connection part 3 is pulled, one end of the connector 41 presses against the spring 42, so that the belt connection part 3 has a pulling space for allowing the strip unit 31 to be taken out of the slot 21; and at this time, the strip unit 31 is clamped between the belt connection part 3 and the belt fastener connection part 2 for forming a gap between the belt connection part 3 and the belt fastener connection part 2, which facilitates opening the cover plate 32 of the belt connection part 3 relatively to the box body 33 to easily replace the belt. After completing replacing the belt, the cover plate 32 and the box body 33 are engaged with each other to combine the upper strips 311 with the lower strip 312, and the belt connection part 3 is rotated to allow the strip unit 31 to be inserted into the slot 21, both the upper strips 311 and the lower strip 312 are restricted by the slot 21 to be closely fit with each other, so that the box body 33 is tightly covered by the cover plate 32, and the nails 321 at the end of the cover plate 32 clamps the belt, thus the belt is difficult to be detached from the belt buckle.

It can be seen from the above description of the present invention, compared with the prior art, according to the rotary belt buckle provided by the present invention, the upper strips are fixed with the lower strip through engaging the upper strips with the lower strip within the slot; when the strip unit is taken out of the slot, the upper strips are detached from the lower strip, so as to avoid the belt from being easily taken out of the belt buckle, and at the same time achieve a quick replacement of the belt, saving time of a user to replace the belt.

Various embodiments in the present specification are described in a progressive manner, each embodiment focuses on differences from other embodiments, and the same and similar parts between the various embodiments can be referred to each other.

The above description of the disclosed embodiments enables those skilled in the art to make or use the present invention. Various modifications to these embodiments are obvious to those skilled in the art, and the general principles defined herein may be implemented in other embodiments without departing from the spirit or scope of the present invention. Therefore, the present invention is not to be limited to the embodiments shown herein, but is intended to be the broadest scope of the present invention consistent with the principles and novel features disclosed herein.

What is claimed is:

1. A rotary belt buckle, which comprises: a belt fastener connection part, a belt connection part, and a spring mechanism, wherein:

the belt connection part is connected with the belt fastener connection part through the spring mechanism, the belt connection part rotates around the belt fastener connection part;

the belt fastener connection part has a slot, a strip unit which is located on the belt connection part fits with the slot;

the belt connection part comprises a cover plate and a box body, the strip unit comprises an upper strip and a lower strip, wherein the upper strip is located on the cover plate, the lower strip is located on the box body;

the upper strip and the lower strip are engaged with each other to fit with the slot, both the upper strip and the lower strip are restricted by the slot;

one end of the cover plate is rotatably connected with the box body, the other end of the cover plate is movably connected with the box body;

a connection shaft, which is located on the box body, is inserted into the slot;

the connection shaft has a connection hole and a stepped surface therein, wherein the stepped surface is provided at an end of the connection hole;

the spring mechanism, which is located within the connection hole, comprises a connector and a spring, wherein the spring is located between the connector and the stepped surface.

2. The rotary belt buckle according to claim 1, wherein the connector has a screw structure, a clamping part is located at one end of the screw structure.

* * * * *